US005553574A

United States Patent [19]

Duncalf

[11] Patent Number: 5,553,574

[45] Date of Patent: Sep. 10, 1996

[54] RADIAL CAM INTERNAL COMBUSTION ENGINE

[75] Inventor: D. James Duncalf, Fremont, Calif.

[73] Assignee: Advanced Automotive Technologies, Inc., Laguna Beach, Calif.

[21] Appl. No.: 395,039

[22] Filed: Feb. 27, 1995

Related U.S. Application Data

[63] Continuation of Ser. No. 244,590, filed as PCT/US92/10517, Dec. 7, 1992, abandoned, which is a continuation-in-part of Ser. No. 803,156, Dec. 5, 1991, abandoned.

[51] Int. Cl.[6] ..... F02B 75/32; F01B 1/06

[52] U.S. Cl. ..... 123/197.2; 123/54.3

[58] Field of Search ..... 123/197.3, 54.3, 123/197.4, 54.1, 55.3

[56] References Cited

U.S. PATENT DOCUMENTS

| | | | |
|---|---|---|---|
| 852,033 | 4/1907 | Philippe . | |
| 1,190,949 | 7/1916 | Philippe . | |
| 1,630,273 | 5/1927 | Nordwick . | |
| 1,730,659 | 10/1929 | Johnson et al. . | |
| 1,735,764 | 11/1929 | Johnson . | |
| 1,775,635 | 9/1930 | Ball . | |
| 1,795,865 | 3/1931 | Kettering . | |
| 2,120,657 | 6/1938 | Tucker | 123/54.3 |
| 3,274,982 | 9/1966 | Noguchi et al. . | |
| 3,311,095 | 3/1967 | Hittell . | |
| 3,482,554 | 12/1969 | Marthins . | |
| 3,572,209 | 3/1971 | Aldridge et al. . | |
| 3,948,230 | 4/1976 | Burns | 92/148 |
| 3,964,450 | 6/1976 | Lockshaw | 91/492 |
| 4,026,252 | 5/1977 | Wrin | 74/44 |
| 4,128,084 | 12/1978 | Sutherland | 123/90.17 |
| 4,301,776 | 11/1981 | Fleming | 123/197.1 |
| 4,331,108 | 5/1982 | Collins | 123/41.35 |
| 4,334,506 | 6/1982 | Albert | 418/150 |
| 4,381,740 | 5/1983 | Crocker . | |
| 4,545,336 | 10/1985 | Waide . | |
| 4,727,794 | 3/1988 | Kmicikiewicz | 91/491 |
| 4,848,282 | 7/1989 | Chaneac . | |

FOREIGN PATENT DOCUMENTS

| | | | |
|---|---|---|---|
| 961284 | 5/1950 | France . | |
| 1375892 | 9/1964 | France . | |
| 314056 | 1/1934 | Italy . | |
| 0996734 | 2/1983 | U.S.S.R. | 123/197.3 |
| 374834 | 12/1930 | United Kingdom . | |
| WO9108377 | 6/1991 | WIPO . | |

*Primary Examiner*—David A. Okonsky
*Attorney, Agent, or Firm*—Frank C. Price

[57] ABSTRACT

A radial internal combustion engine with a rotatable cam unit. A cam follower is attached to the end of each rod connecting rod for engagement with the cam unit. Rod guide means is provided to maintain alignment of the connecting rods. A further embodiment also provides that three rollers, which rotate about a common axis, provide engagement with the cam unit.

9 Claims, 12 Drawing Sheets

RADIAL CAM INTERNAL COMBUSTION ENGINE

This application is a continuation application of U.S. application Ser. No. 08/244,590, filed Jun. 1, 1994, now abandoned, which is a U.S. national phase of International Application No. PCT/US92/10517, filed Dec. 7, 1992, which is a continuation-in-part application of U.S. application Ser. No. 803,156, filed Dec. 5, 1991, now abandoned.

FIELD OF THE INVENTION

The present invention relates generally to internal combustion engines. More specifically, the present invention relates to an internal combustion engine driven by pistons housed within stationary cylinders arranged in a substantially radial layout and using a central Rotating Cam Unit (hereafter referred to as the "RCU"), preferably having three raceways to move the pistons and a valve train. This rotating RCU takes the place of the conventional crankshaft.

BACKGROUND OF THE INVENTION

The history of all internal combustion engines (e.g., Otto cycle, Diesel, and two-stroke) can be traced to 1678 when a Frenchman named Abbe Hautefeuille proposed using the power of gun powder in a cylinder to move a piston ad obtain work. His principle is used today on aircraft carriers to thrust planes into the air. The first successful working engines used walking beams, (Street's engine 1794) and rack and gear arrangements (Barsanti's and Mateucci's 1856 and Otto's and Langen's 1866) to convert the piston's reciprocal motion into rotary motion. The steam engine was the most popular source of mechanical power those days and it was not long before the crankshaft of the steam engine became a standard feature of the internal combustion engine. The crankshaft worked very well on a steam engine. The pistons seldom reciprocated more than a few hundred strokes per minute, well below destructive frequencies. The oily steam provided cooling and lubrication. The pistons were aligned so that there was no side pressure, only thrust, on the bores. The pressure was slow and steady and was often applied to both sides of the piston. Compare to this environment inside the modern internal combustion engine. The pressure is not slow but explosive. The heat is high enough to melt many metals. The working fluid is not oily steam that lubricates but white hot flames containing caustic acids. The hot gas blows by the piston and turns the oil into an etching solution.

In light of this one must admit that the modern internal combustion engines have been made very durable. However, while they may be regarded as highly developed, they are in fact less efficient than is possible since conversion of the heat energy to mechanical energy is done through the piston, connecting rod and crankshaft.

The piston's linear movement in the power stroke is the initial conversion step from heat energy to mechanical energy. The linear motion is in turn converted to the angular motion of the connection rod which in turn develops the circular motion of the crankshaft. Piston scuffing, at this stage in the conversion is caused by tremendous side pressure the crank's geometry exerts on the piston. Nevertheless, this is only one of many problems created by the use of a crankshaft.

A substantial amount of energy, and therefore efficiency, is lost from the combustion process because of the inefficiencies of the leverage geometry that is inherent in the crankshaft system. But perhaps the worst design flaw of crankshaft engines are their inherent imbalance.

A relative state of dynamic balance is achieved with the addition of compensating weights or rotating balance shafts. As engine speeds change, the resonance frequency of these weights are reached and they start to shake the engine. This creates frustrating problems for engine designers. In some modern engines as many as nine rotating and counter rotating shafts are needed to smooth this inherent imbalance.

But besides the balance problems caused by the moving mass, there is the explosive nature of the combustion process itself. An Otto cycle engine has a power generation stroke of approximately 160 degrees duration which occurs only once every other rotation (720 degrees) on a given cylinder. This translates into power input only 22% of the time. Because the pressure decreases as the volume of the combustion increases and because the leverage on the piston is changing with rotation of:the crank the forces are not transmitted in a smooth thrust as in a steam engine. This infrequent and uneven pulse of power is another inherent design problem to these engines. To overcome this, designers have pursued two routes. First, they used heavy flywheels to lessen the jolt of the explosion and carry the momentum to the next power stroke. These engines were very heavy for their power output. Some early one horse engines weighed more than a horse. Later designs were developed that use several pistons, each with their own offset on the crankshaft. This permitted the power strokes to overlap. An eight cylinder engine has four overlapping power strokes, per revolution. But this brought with it more balance problems to be overcome and more rotating and counter rotating weighted shafts and the gears or chains to power them. Any excess dynamic weight which must be designed into an engine to defeat this inherent balance flaw only adds to the inertial and friction load that the engine must overcome. These friction losses in the crankshaft system are well recognized and have been extensively studied over the years.

The combustion process in the standard Otto cycle engine is another area where improvement could be made. As far back as 1873, Brayton, an American, developed an engine which had the unique feature of utilizing the power of the complete expansion of the gases of combustion, much like the multi-stage steam engines that made ocean-going ships practical. He did this with the use of two cylinders beside each other and a very complex system of valves. One cylinder was used to pre-compress the air/fuel mixture. The other was large enough to obtain the complete expansion to atmospheric pressure of the exploded gases. Though large numbers of the engine were made the friction and inefficiency of the crank and large and complicated valve train brought only a slight improvement over the competing Otto cycle engine. Although the Brayton process was abandoned for the piston engine, it is still Used for the gas-turbine engine process.

In the last fifty years the crankshaft engine's many shortcomings has fueled a great deal of research into alternative designs. The results have brought forth several rotary designs, the turbine, and other types of compact power units. For one reason or another most have failed to capture the attention of the world's engine makers to date. There is, however, a great need, especially in the automotive industry, to develop a better engine. Initially the search was for high specific power output per pound of weight. More recently the development has focused on improved mileage and reduced pollution.

However, there are several fundamental reason why the automotive industry has not leaped into the production of any of these new engine designs. Most new engine designs lead to larger, heavier, more complex and more expensive units than conventional power plants. Also, all recent new designs have been radical departures from known, proven technology. This is particularly true of external combustion engines. But when considering the immediate, reasonable alternatives such as the Wankel rotary or the gas turbine, it is clear that each has difficulties. Both have not been widely accepted because of their poor efficiency. Another problem they share is the fact that these design cannot be easily manufactured with the billions of dollars of machine tools, special equipment and labor force that are place in the world's auto plants. Tax laws and depreciation schedules make it hard for a manufacturing firm to make a rapid change. So while these two engines' place in aircraft and small sports cars production is perhaps assured, it is not likely that the will ever be used in large numbers.

As previously noted, the conventional internal combustion engine inefficiency transfers energy from reciprocating pistons to the drive shaft because of energy losses sustained in the crankshaft connecting rod mechanism. This layout increases the complexity of the engine by requiring considerable balancing devices. Further, the conventional internal combustion engine cannot decompress the products of combustion all the way down to atmospheric pressure, thus wasting large percentages of the power potential of the combustion. Also, the conventional internal combustion engine suffers from blow-by problems (the leakage of combustion gases goes directly into the crankcase area contributing to pollution), does not burn fuel completely, creating high fuel consumption, horsepower losses and pollution emissions.

As stated above, prior internal combustion engines, including radial engines, have suffered great inefficiencies because they inadequately dealt with all the forces which are applied to the piston and connecting rod. Prior art engines, while utilizing the forces which act parallel to the centerline of the piston, have inadequately dealt with the forces acting upon the piston and rod which do not act parallel to this centerline. These extraneous forces, such as those on a crank rod when the rod is not lying along the centerline of the combustion chamber bore, are typically transferred to the piston or rod. When transmitted to the piston, the piston binds against the walls of the combustion chamber. When transmitted to a rod which passes through a bushing, the rod tends to bind. In either case, the extraneous forces lower the efficiency of the engine as the frictional forces increase on the piston and/or rod.

Therefore, an improved internal combustion engine is desirable, which would: (a) effectively control and dissipate extraneous forces from the piston and rod, (b) convert more of the energy of the expansion of the combustion gases into power output, (c) provide for the efficient conversion of reciprocal motion to rotary motion (d) reduce pollution emissions (e) be inherently dynamically balanced (f) have a large number of power pulses per revolution for smooth running, (g) provide a simple design to minimize component parts, (h) be easy to construct with the existing infrastructure found in most plants today.

Among the prior art references considered to be f interest are U.S. Pat. Nos. 3,482,554 (N. Marthins), 3,948,230 (A. Burns) and 4,334,506 (A. Albert).

U.S. Pat. No. 3,482,554 to Marthins discloses a V-type combustion engine having a lobed cam disc 3 with equally spaced cams 4. A piston rod 9 is firmly fastened to a piston 8 at one end and a roller 10 at the other. Rotation of the cam disc 3 results in upward movement of the pistons 8 and downward movement is caused by combustion thrust in the cylinder.

U.S. Pat. No. 3,948,230 to Burns discloses a rotary engine comprising a first triangular, shaped rotor 14 with clover shaped secondary rotors 15 rotatably mounted on each of three lobes 16 of the first rotor 14. The secondary rotor 15 moves in the reverse direction with each lobe engaging the concave section 29 of the base of every third piston 19.

U.S. Pat. No. 4,334,506 to Albert discloses a reciprocating rotary engine having a hollow stationary block with elliptical shaped cam surface 62. Pistons 28 are joined by piston rod 30 to a roller bearing 42. The elliptical surface allows the piston to make a complete stroke within a predetermined number of degrees of rotation in a single revolution.

The foregoing patents, however, do not disclose an improved internal combustion engine which provides for the efficient conversion of reciprocal motion to rotary motion while reducing pollution emissions and providing a simple design which minimizes component parts. Both Marthins and Albert do not disclose an engine having pistons in a radial cylinder layout. Also, those patent invention do not eliminate all unburned exhaust emissions.

SUMMARY OF THE INVENTION

The present invention overcomes the limitations of the prior art by providing a radial internal combustion engine that provides for the efficient conversion Of reciprocal motion to rotary lotion while reducing pollution emissions and providing a simple design which minimizes component parts.

According to the invention there is provided an internal combustion engine comprising:

an engine block;

a drive shaft;

a plurality of cylinders arranged in a radial pattern in a plane substantially perpendicular to said drive shaft;

a plurality of pistons, one disposed in each of said cylinders;

a plurality of connecting rods, each having first and second ends, each of said pistons ;being connected to one of said rods at said first end;

a cam, rotatable about said shaft in said plane and having a plurality of cam surfaces around said cam, first and second of said surfaces facing inwardly towards said drive shaft, a third of said surfaces facing outwardly away from said drive shaft, said first and second surfaces being on either side of said third surface;

a plurality of cam followers coupled to each one of said rods at said second ends, first and second of said followers adapted to engage said first and second cam surfaces, respectively, and a third follower adapted to engage said third cam surface;

so that, in use, when said cam rotates, said first and second cam surfaces engage said first and second cam followers to pull the connecting rod they are coupled to and said third cam surface engages said third cam follower to then push said connecting rod, The invention also provides a radial internal combustion engine comprising:

an engine block;

a drive shaft rotatably disposed along a centerline of the engine block;

a rotatable cam unit, aid rotatable cam unit having a plurality of cam extensions, each of said cam extensions having a rising edge and a falling edge, said rotatable cam unit being mounted to said drive shaft, said cam being rotatable in a plane substantially perpendicular to said drive shaft;

a plurality of cylinders arranged in a radial pattern around said rotatable cam unit;

a piston disposed in each of said cylinders;

a number of connecting rods, the number of said rode corresponding to the number or said pistons, each piston having one end of one of said rods connected thereto;

at least one cam follower coupled to the end of each rod located opposite the end attached to said piston, said cam follower adapted to engage said cam extensions on said rotatable cam unit;

rod guide means for maintaining alignment of said rods and limiting the movement of each rod in all directions except along its longitudinal axis, said guide means comprising male and female engagement members, one category of said members being associated with said rod for movement therewith, the other category of said members being fixed with respect to said rod.

Another embodiment of the invention provides a cam for an internal combustion engine for translating the reciprocating motion of pistons to the rotational movement of a drive shaft comprising a central cam body; a central innermost cam surface on said cam body, one each of said outer surfaces lying on apposite sides of said central cam surface.

The invention also provides a connecting rod assembly for attachment to a piston of an internal combustion engine, in which reciprocating motion of said piston is transmitted by said rod to a rotatable cam, said assembly comprising: a shaft having a longitudinal axis and two ends, a first end of which is adapted for attachment to said piston;

a plurality of cam followers, which having a surface for engaging said cam and being mounted to said second end of said shaft with said surface substantially perpendicular to said axis, said followers comprising at least one primary cam follower mounted symmetrically about said axis of said rod, and at least one secondary cam follower offset from said axis.

More particularly, in a preferred embodiment, the present invention provides a centrally located Rotating Cam Unit (i.e., RCU), which is coupled to a drive shaft. The RCU has a series of cam extensions formed into its outer edge. In the preferred embodiment, the RCU is designed to work in conjunction with four pistons. The specific RCU shape is designed to provide constant acceleration of the pistons. The four cylinders are disposed in a radial fashion around the RCU, and a piston is located within each cylinder. The pistons have cam followers located at their bases. As the RCU turns, the piston is forced upward into the cylinder by the rising edge of one of the cam extensions. This causes the piston to compress the air and fuel mixture. A spark plug in the cylinder, in turn, ignites the mixture and the resulting combustion forces the piston downward. As the piston travels down its particular cylinder, the cam follower engages a falling edge:of the cam extension thereby displacing the RCU and associated drive shaft laterally, thus inducing rotation motion thereto. Cooling is provided when the piston uncovers both intake and exhaust ports at the bottom of the stroke, allowing air from the intake compressors to move into the piston and out through the exhaust. Consequently, the present invention produces high torque at low speeds, eliminating the need for gear boxes.

The present invention also increases the number of power strokes per drive revolution over conventional engines and minimizes the equipment necessary to achieve balancing through the use of a RCU by eliminating the need for a crankshaft. Further, friction losses are minimized since the present invention requires only two main bearings. In an alternative embodiment diesel version of the present invention engine, unburned exhaust emissions are eliminated through the use of a lean fuel mixture.

The present invention provides many advantages over the prior art engines. Primarily, the use of a unique rod guide system reduces friction and binding of the connecting rods and the pistons. Cam followers located on the end of the rod opposite the piston contact raceways on the RCU. As the RCU rotates, these followers roll along the raceways, transmitting forces between the rod and RCU, causing the piston to reciprocate in the combustion chamber.

At an end remote from the piston, the rod has elongate members which engage rod guides. The rod guides are preferably attached to or part of guide plates which are attached to or formed as part of the engine block. The elongate members preferably engage the rod guides in a rib and slot arrangement, and limit motion of the rod in all but the direction in which the piston reciprocates.

The unique manner in which the rod is restrained permits destructive forces those which do not act along the centerline of the piston) to be transmitted to the engine block where they are dissipated. This arrangement prevents these forces from being transmitted to the piston or rod where they would cause high friction and binding, resulting in engine inefficiencies.

Further, in a preferred embodiment, every revolution of the output shaft of the present invention creates two power strokes per cylinder. This allows the present invention in the four-cylinder engine embodiment to have the same number of power strokes per revolution as a sixteen-cylinder Otto cycle engine. In a preferred embodiment, the combustion chamber has a compression chamber of equal size behind the moving pistons that any blow-by is not allowed to contaminate the oil or cause pollution, but is recycled back into the combustion chamber and out of the engine. The pistons are reciprocated by said RCU having three raceways. The main cam surface lies in the center of the RCU facing in the direction of the pistons, and transmits the piston's power (down force) directly to the shaft. The other two cam surfaces are on each side of this main cam, face away from the pistons and toward the central shaft, and are used to retain the piston's dynamic forces during its return to the top of the stroke. The RCU has two lobes or cam extensions that are shaped to provide even acceleration and deceleration forces on the piston connecting rod assembly.

The RCU's raceway surfaces are traversed by specially designed cam follower roller bearings. More particularly, there are preferable three followers located on the end of each rod opposite the piston. One central follower traverses the central raceway, transmitting the downward force of the piston to the RCU, as well as pushing the piston upwards as the followers travel over one of the cam extensions. Two outside followers are also mounted on the end of the rod. Each of these followers travel on one of the outer raceways on the RCU. These followers aid in guiding the piston on its downward stroke, as well as retain the piston during its return to the top of the cylinder.

The piston and the top end of the engine function somewhat similar to Brayton engine cycle, only with less parts and one less cycle. In the Brayton engine there were commonly two pistons and two cylinders. Brayton also had a separate combustion chamber above and between the two pistons. The one piston compressed the fuel air charge into the combustion chamber above and between the two pistons. The one piston compressed the fuel air charge into the combustion chamber where it exploded. It was then bled into the power chamber where it pushed the piston through its power stroke. On this power stroke the charging piston was drawing in another charge. On the upper stroke the power piston exhausted its burned charge and the process started again, In the present invention, the two piston chambers exist above in the cylinder, on top of the piston. When the power stroke is pushing the piston down, it is compressing air charge under the piston and squeezing it into a precombustion chamber beside the piston where, with explosive force, it rushes into the combustion chamber as the port is uncovered. By this time the exhaust port has opened and the burned charge is partially exhausted. So there is no exhaust stroke in the power chamber, only a compression and power stroke.

Thus,in the present invention engine, the piston forces the air into a chamber beside the piston (the pre-combustion chamber) rather than into the crankcase as in most conventional two-cycle engines. This improves the efficiency of the present invention engine over the standard two-cycle and removes the necessity to add oil to the gas. It also eliminates the obvious emission problems caused by such. Valving is by a combination of ports covered and uncovered by the piston and reed valves on the intake.

The dynamics of the present invention are inherently balanced. Each piston has a counterpart that is in perfect dynamic synchronization. Moreover, in the preferred embodiment, ninety degrees in either direction within a common plane is another pair of pistons that are also moving in the same fashion but in the opposite phase. The dynamics of all four pistons are equal in time and forces. For every movement and force in the engine there is an equal and exactly opposite force to counteract it. This, coupled with the eight power pulses per revolution (twice the number of a V-8), permits the present invention to rival an electric motor in smoothness.

This balance and smooth dynamic performance is achieved by design and not by the addition of several power robbing counter weights or counter rotating shafts. Indeed, the high polar axis of the RCU eliminates the need for a heavy flywheel. Also, the lack of a power robbing valve train further increases the engine's efficiency. The present invention's simple configuration lowers the overall weight of the engine, which translates into less vehicle weight and greater vehicle efficiency.

The present invention has other advantages over prior art engines. In the preferred embodiment, the present invention uses 12 oil pressure bearings and 2 anti-friction bearings as opposed to as many as 40 metal-to-metal bearings in a standard V-8 engine. Moreover, the present invention in the preferred embodiment has only nine major moving parts: the RCU, four pistons, and four connecting rods. Compare this to the average V-8 engine, which has a crank, eight pistons, eight rods, two valve train sprockets, a timing chain, one cam shaft, sixteen hydraulic valve adjusters, sixteen push rods, sixteen rocker arms, sixteen valve springs, and sixteen valve valves, or approximately ten times the number of major moving parts as the present invention. Fewer parts translates well into a less expensive and lighter engine, having less internal friction per horsepower of output.

In addition, the present invention operates at a slightly lower speed range than conventional engines because the RCU receives the force of the piston at a much greater distance from the center of the output shaft than the 1.5 to 2 inches of the standard automotive engine. Here, the piston forces have a larger leverage over the load and consequently produce a greatly increased torque output. The present invention is small in size and has a low center of gravity, which allow a greater flexibility of use in many applications. Indeed, the present invention can be configured so that it can bolt up to a standard off-the-shelf transmission or transaxle, with only slight modifications that can be performed by any person skilled in the art. Other configurations of the present invention engine are easy to design because oil is not splashing against the bottom of the piston.

DETAILED DESCRIPTION OF THE PRESENT INVENTION

In the following description, numerous details, such as specific component shapes and quantities, are set forth in order to provide a more thorough description of the present invention. In other instances, well known components and manufacturing methods are described in general terms so as not to obscure the present invention unnecessarily.

The present invention relates to a novel, two stroke, radial, internal combustion engine with pistons being reciprocated by a lightweight Rotating Cam Unit, which in a preferred embodiment is made of hardened, high carbon steel. The present invention is now described with reference to the drawings appended hereto.

Figure 1:
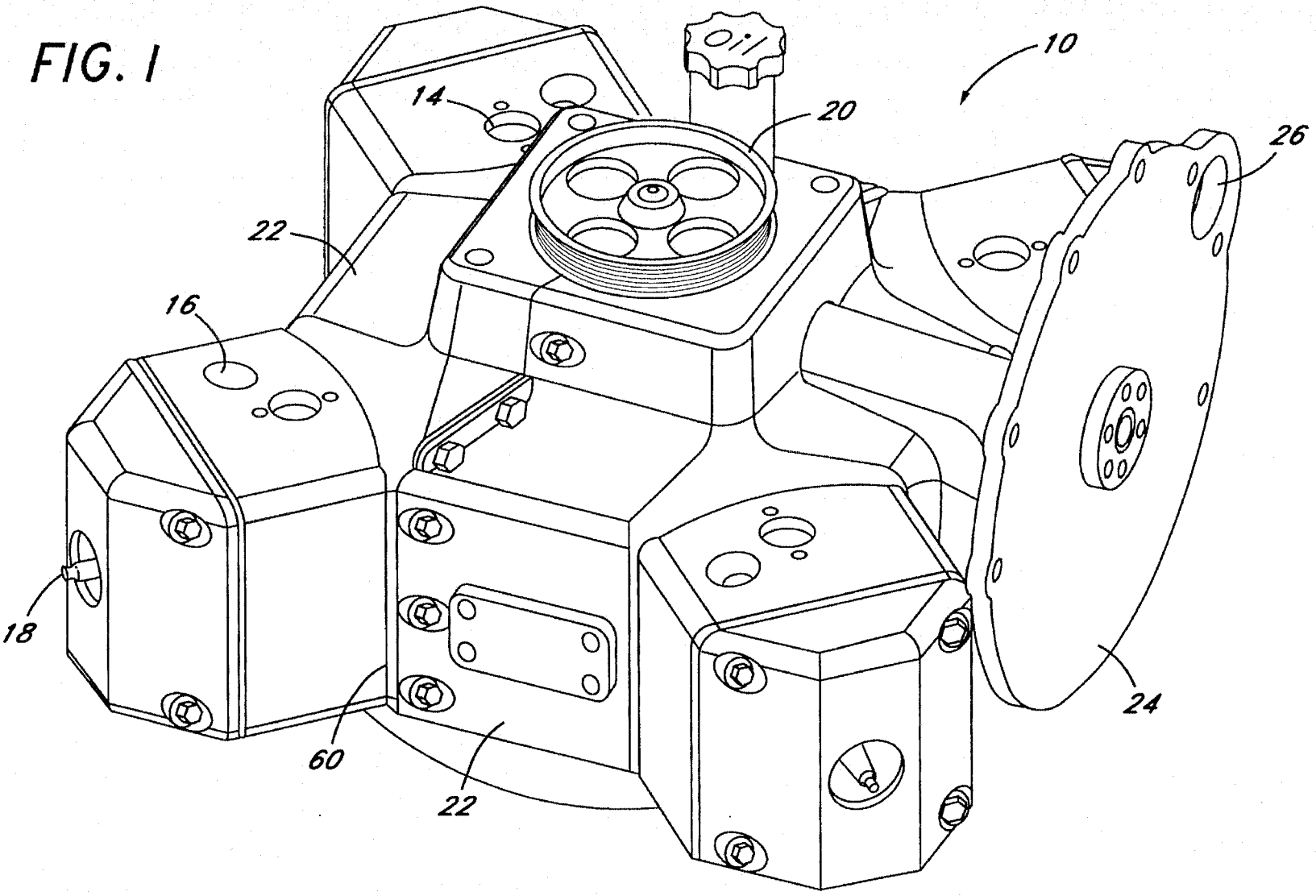
FIG. 1 is a perspective view of an engine of the present invention.

As seen in FIG. 1, the present invention 10 preferably has four radially disposed cylinder heads 12. Each cylinder head has an intake port 14 and an injector port 16. The intake port 14 is used for air intake, while the injection port 16 is used for fuel intake. The required fuel injection mechanism and air intake hardware are known in the art and have been omitted from the drawing. A spark plug 18 is positioned at the top of each cylinder head 12.

Figure 2:
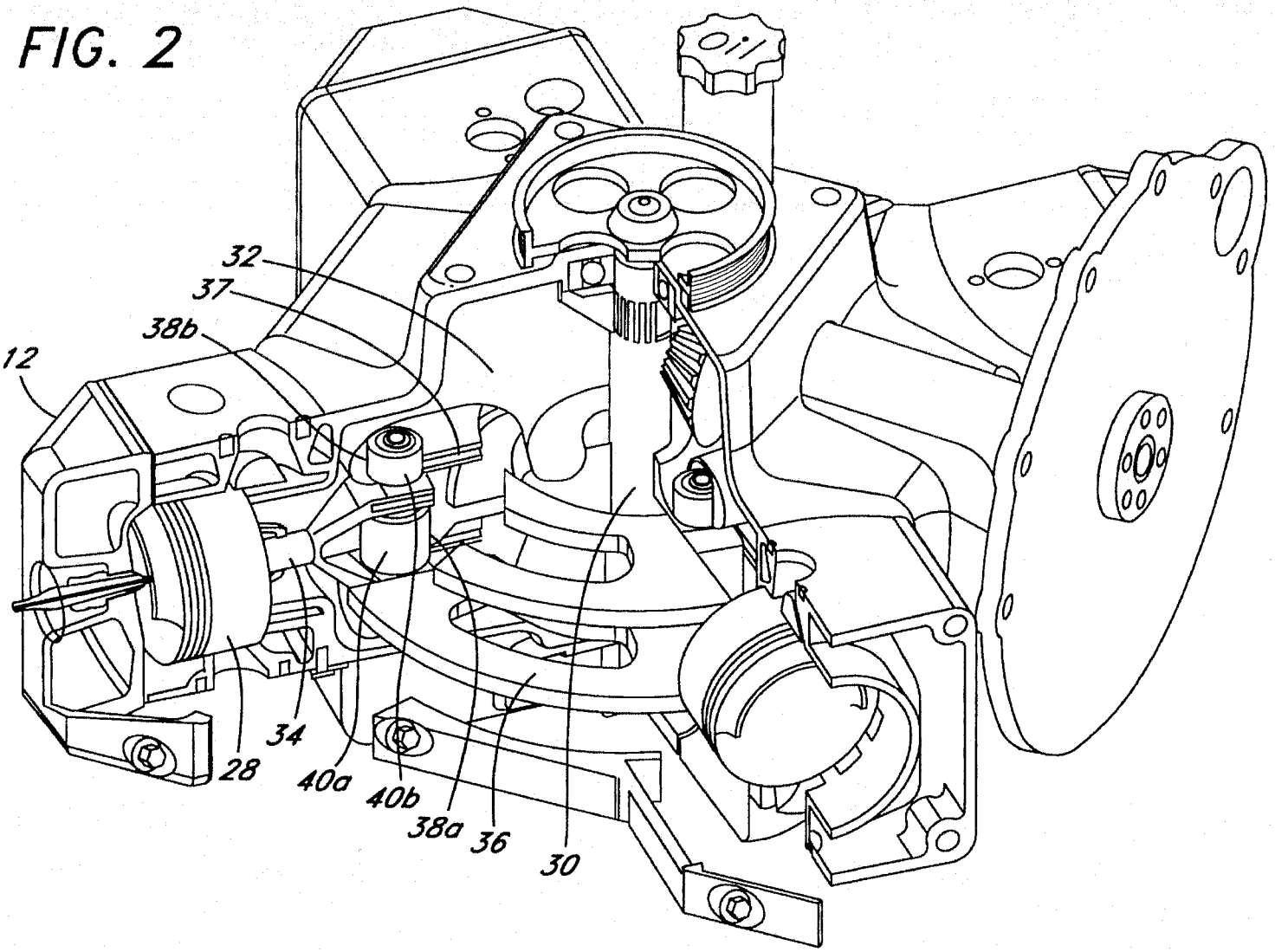
FIG. 2 is a cut-away view of an engine of the present invention where a quarter section of the engine has been removed.

In the embodiment illustrated in FIG. 2, an accessory pulley 20 for connecting belts and the like, known in the art, is connected to the shaft 30. To one end of the engine block 22 is a bell housing attachment 24 through which the power is transmitted by coupling the shaft 30 to another shaft mounted at 90 degrees thereto and coupled by a drive system 56. A started attachment area 26 is located on the bell housing attachment 24 for mounting a starter to the engine 10.

FIG. 2 provides a cutaway view in which one quarter section of the engine 10 is cut away to reveal the internal structure of two cylinder heads 12 and the engine block 22. As shown in the drawing, the preferred embodiment of the present invention employs a drive belt 30 coextensive with an imaginary centerline of the engine block 22. Mounted concentrically with the drive shaft 30 is a Rotating Cam Unit 32, hereafter called the RCU. A central raceway 38*a* and two outer raceways 38*b* are located on the RCU 32.

Each piston 28 is arranged with respect to the drive shaft 30, and reciprocates in a radial direction. A connecting rod 34 is connected to the piston 28 at one end, and has at its other end three cam followers 40*a* and 40*b*. The cam followers 40*a* and 40*b* are preferably rollers which travel on the raceways 38*a* and 38*b* of the RCU 32 to transfer the motion of the piston 28 driven rod 34 to the RCU 32 and visa versa. Preferably, there are three cam followers on each connecting rod 34: a center main follower 40*a*, and two outside followers 40*b*. Rod guide plates 36 having rod guides 37 thereon are located on each side of the connecting rod 34 so as to maintain alignment of the connecting rod 34 as it undergoes its reciprocating motion.

Figure 3:
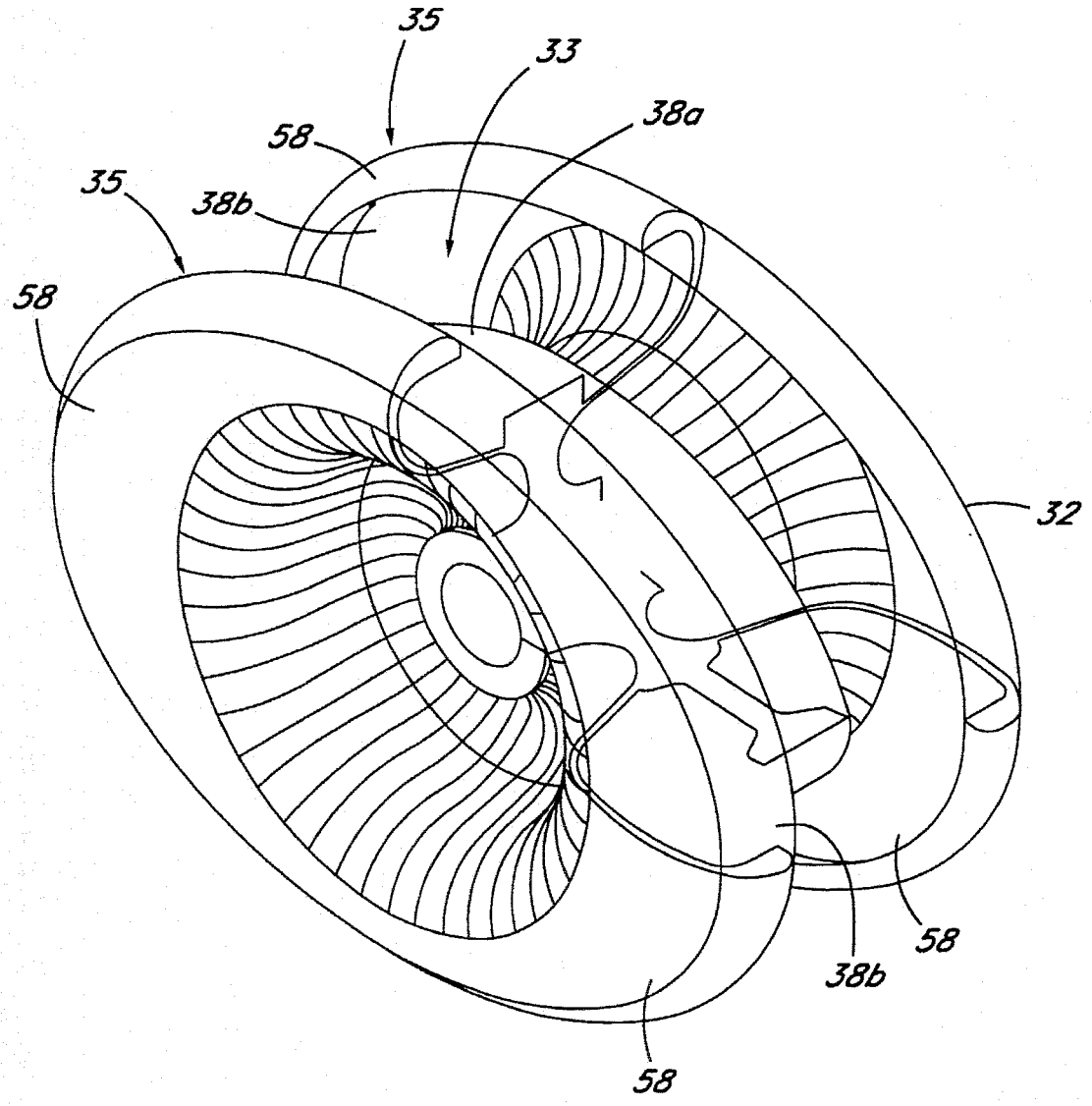
FIG. 3 is a perspective view of a rotating cam unit for an engine of the present invention.

FIG. 3 gives a perspective view of the RCU 32 when used in conjunction with the preferred embodiment engine 10 having four cylinders. The RCU 32 generally comprises a central core 33 having a central raceway surface 38*a* which faces outwardly, and outer wings 35 having outer raceway surfaces 38*b* which face inwardly. As will be described in more detail later, the raceway surfaces 38*a* and 38*b* are traversed by cam followers 40*a* and 40*b* located at the base of each connecting rod 34 connected to the piston 28. Thus, center follower 40*a* rides on the outwardly facing surface 38*a* and the outside followers 40*b* and 40*b* ride on the inwardly facing surfaces 38*a* and 38*b*.

Because the cam followers 40 ride on the raceways 38*a* and 38*b* of the RCU 32, the shape of the raceways 38*a* and 38*b* dictate the motion of the pistons 18 as the RCU rotates. The particular shape of the raceways 38*a* and 38*b* is thus important, as it dictates the motion of all of the pistons 18. As illustrated in FIG. 3, as well as in FIGS. 11 and 13, in order to drive four pistons 28 at two cycles per revolution of the RCU 32, the RCU 32 must have two rising areas which push the piston 28 upwardly, and two falling areas allowing the piston 28 to reach the bottom of its stroke. In this case, the RCU 32 has a generally oval shape, wherein there are two cam lobes or extensions 58 which act as the portion of the RCU 32 where the piston 28 is at the top of its stroke.

It is desired, however, that the lateral forces to which the pistons 18 and the rods 34 are subjected be minimized and controlled. To accomplish this, the raceways 38*a* and 38*b* are designed to have a cam shape which causes the piston 28 and rods 34 to move with constant acceleration. In this manner, random peak forces are eliminated, and the constant acceleration is chosen so that the resultant forces are less than a desired maximum, this maximum chosen primarily by the constraints of the materials from which the engine 10 is manufactured. Further, a constant acceleration (from the viewpoint of piston movement) cam shape provides for "dwell" time for the piston 28 at the top and bottom of its stroke. This dwell time allows more time for the exchange of exhaust gases for combustion gases at the bottom of the piston 28 stroke, and for more complete ignition of the gases and fuel at the top of the piston 28 stroke. While other cam shapes can be designed to maximize the dwell time, these cams are less desirable because they are not constant acceleration cams.

When designed to be a constant acceleration cam, the exact shape of the raceways 38*a* and 38*b* is a function of the diameter of the cam followers 40*a* and 40*b*, the stroke of the piston 18, and the desired maximum diameter of RCU 32 and the stroke of the piston 18 is preferable two (2) inches. A two inch stroke is chosen in order to minimize the force on the rod 34, and yet provide sufficient volume variation in the combustion chamber 42 to achieve good combustion. The diameter of the cam follower 40 is chosen to be as small as possible while at the same time being large enough to be positioned on bearings which have a load bearing capacity larger than the forces which will be applied to the follower 40. The largest outer diameter of the RCU 32 (and thus outer raceway 38*b*) is minimized in order to keep the engine 10 as small as possible.

Once the above three parameters have been chosen, the exact shape of the raceways 38*a* and 38*b* is determined mathematically. This can be done manually by plotting points to create the cam shape of the raceways 38*a* and 38*b*, or if can be accomplished with a computer program which both calculates the points and then represents them graphically. In either case, the task of determining the RCU 32/raceway 38*a* and 38*b* shape is simplified since it is preferred that four pistons be utilized. In this case, for all four pistons to have the exact same motion for each revolution of the RCU 32, each 90 deg. segment of the RCU 32 must be the same. Therefore, only one 90 deg. segment of the RCU 32 profile need be determined, and then superimposed four times to create the 360 deg. profile.

If the manual method is used, the raceway 38*a* and 38*b* shape is determined by drawing the profile of the cam. First, a displacement diagram is prepared. This diagram illustrates the position of the rod and piston, as plotted on the y-axis, as against the cam rotation angle or time as plotted on the x-axis. In other words, this diagram is a linear depiction of the piston and rod motion.

The x-axis is first divided into a number of divisions, for example 5 degree increments. It is known that the piston is to travel from the bottom of the combustion cylinder to the top, and top to bottom, each in 90 degrees in the preferred embodiment. Therefore, the stroke of the piston, preferable 2 inches here, is marked on the y-axis. Knowing that the piston must be at 0 inches at 0 degrees, and at 2 inches at 90 degrees, these points are marked on the graph.

Next, a line is drawn from the origin of the axes at an acute angle. Since the piston must rise the entire stroke distance in the 90 degrees, and knowing that the points are being plotted every 5 degrees, there are displacement points to be determined at the 18 increments of time. Because the piston moves with constant acceleration, the distance the piston moves during each time or angle increment is proportional to the time squared. Therefore, for time increment 1, that during 0 to 5 degrees, the piston moves a distance increment of 1. During the second time increment, 5 to 10 degrees, the piston moves to 4, etc.

It is known, therefore, that during the nine time increments between 0 and 45 degrees, the piston must move 81 increments. Eighty-one equally spaced marks are therefore laid off onto the line drawn. A line is drawn from the eighty-first mark to the y-axis corresponding to the 2 inch stroke. Lines parallel to this one are then drawn from the first, fourth, ninth, etc. increment to the first, fourth, etc. increment to the y-axis. Lines parallel to the x-axis are then drawn from these intersection points across until they meet the 5, 10, 15, etc. degree lines. These intersection points lie on the displacement line. A line is then drawn through each point, illustrating the displacement. An acute line is drawn and the same method of point plotting is used to obtain the displacement curve for the 45 degree to 90 degree portion of the graph. Of course, because the cam is used in conjunction with four pistons, the displacement diagram for each 90 degree segment is the same, and therefore only this one segment need be determined.

Next, the profile of the cam (and thus raceway) is plotted from the displacement diagram. First, one picks the maximum outer dimension of the cam (thus raceway 38*b* ), for example 10 inches. A follower diameter is chosen, as described above; for sake of example 2 inches will be used here. The rod and follower are drawn pictorially to scale. A central point is located along the centerline of the rod a distance of 4 inches from the circumference of the follower (this distance is determined by subtracting two times the stroke and two times the follower radius from the maximum cam dimension). Once point O is located, a circle is drawn around it which passes through the center of the follower. Next, the circle is divided up into angle increments corresponding to that used on the displacement diagram. From the displacement diagram, distances are marked along the rod up from the center of the follower. Then an arc is drawn from each increment, with the center of the arc at O, until it hits the corresponding angle line emanating from point O. Each of these arcs are drawn until a series of points are plotted 360 degrees around point o. A line is drawn through these points, which line defines the path of the end of the rod. The profile of the raceway, and thus the points along which the follower contacts, is located a distance equal to the radius of the follower inside of the path center of the follower.

If the computer program is used, the above manual method of determining the points is converted into a number of formulas, with the resultant being that the raceway 38*a* and 38*b* shape is defined by a number of points having x and y coordinates. These points are plotted graphically by the computer, and a printout of the raceway 38*a* and 38*b* shape is printed.

First, the 360 degree cam is arbitrarily divided up into an incremental unit of measure K. For example, the cam may be divided into 1 degree increments so that 360 sets of cam profile points are generated. Of course, the smaller the increment K, the more accurate the profile will be. It is assumed that the piston starts at the bottom of its stroke, so that the center of the follower C, when K is O, is equal to ). The follower (and thus piston) position at the next cam increment (k equal to 1) is then calculated. This position C is equal to the previous follower location plus a time factor T squared multiplied by an arbitrary acceleration index factor F. T is merely an incremental unit chosen to divide up the total time it takes the piston to move from the bottom to top, and top to bottom, of its stroke. In the case at hand, if T is chosen to be 0.333, T will go from) to 15 when the cam profile is calculated from ) to 90 degrees and the increment K is one degree. Then T will go from 15 to 0 for the next 90 degrees. Arbitrary index factor F represents the constant acceleration figure, and is chosen to be small enough that during the full 90 degree rotation in which the piston moves its complete stroke, this factor times the total time T squared, gives a distance which is at least an amount greater than the total stroke distance of the piston. In the current example, when T is 0.33 and k is 1 degree, F equal to 0.000269 works well.

Next, the distance E from the center of the cam to the center of the follower is calculated. Initially this distance E is equal to an arbitrarily chosen distance X, which is selected based on the estimated size of the cam which will fit within the engine being designed. After one increment of time, the position E is equal to X plus the distance C, calculated above.

From E can be determined XC and YC, the coordinates defining the center of the follower at the specific increment K. Position XC is found by taking the cosine of E multiplied by the number of radians represented by angle increment K. Position YC is found by taking the sine of E multiplied by the number of radians represented by angle increment K.

Knowing the coordinates XC and YC of the center of the follower, the corresponding cam profile coordinates XP and YP are calculated therefrom. In order to do this, the incremental distance F which the center of the follower moved from the center of the cam as the follower moved to its new position at the new increment K, is calculated by subtracting the previous radial position E from the current radial position E. Next, the angular relation between a straight line between the points through which the center of the follower has traveled and an approximated radial line is calculated. This angle A is equal to the arc tangent of G divided by F, where G is E expressed in radians.

The coordinate XP of the cam profile at the increment K is then XC minus the cosine of A multiplied by the radius of the follower (which as described above, is pre-chosen). The coordinate YP of the cam profile at the increment K is then YC minus the sine of A multiplied by the radius of the follower. Note that since this calculation gives the coordinate position of the central raceway cam profile, if the values of cosine and sine of angle A multiplied by the radius are added to XC and YC, the coordinates for the outer raceway cam profile are yielded.

By representing the above steps through 360 degrees worth of iterations, a set of points represented by X and Y is yielded, these points defining the entire raceway or cam profile desired.

Figure 4:
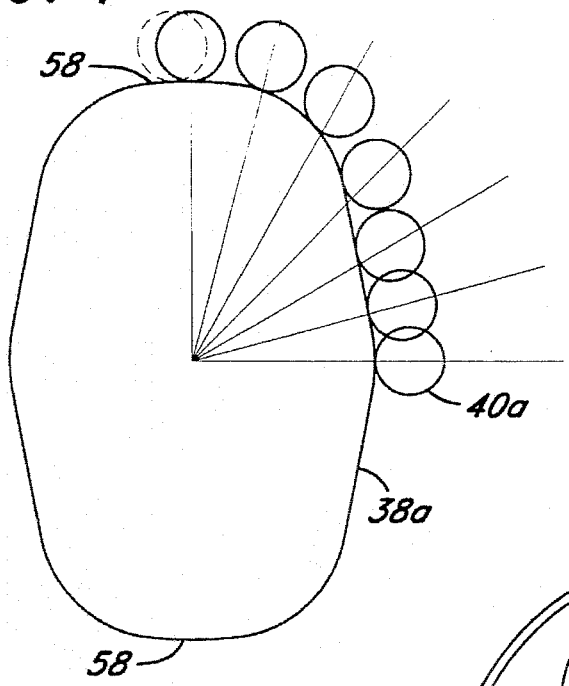
FIG. 4 illustrates the shape of a rotating cam unit for an engine of the present invention.

FIG. 4 illustrates one raceway 38*a* and 38*b* profile. In this figure, only the central raceway 38*a* profile is illustrated. This raceway 38*a* provides constant acceleration of the pistons 18 when the widest dimension of the raceway 38*a* is 14.5 inches, he stroke of the piston 28 is two inches, and the diameter of the followers 40*a* and 40*b* is 1.375 inches. This RCU 32, and thus raceway 38*a* and 38*b* shape, is believed to be acceptable from a performance standpoint, however, this design is not the most preferred, because of the large outside RCU 32 dimension, and, therefore, correspondingly relatively large engine size. As can be seen, this profile still retains a shape wherein there are two cam extensions 58.

Figure 5:
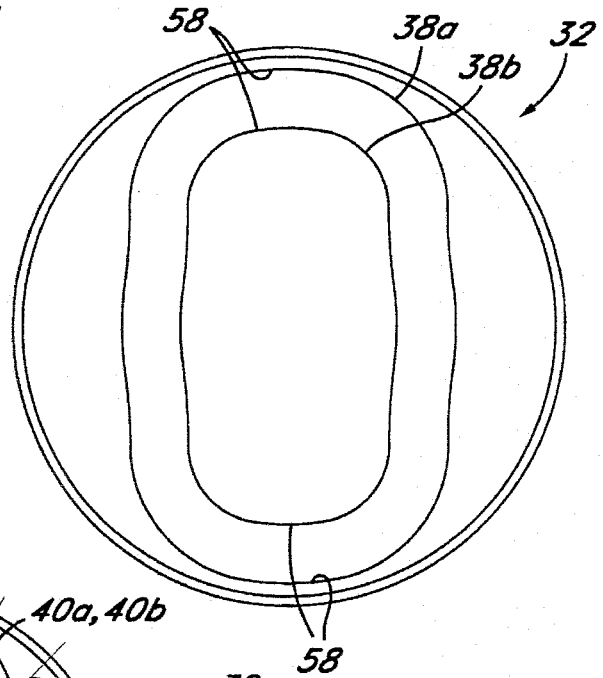
FIG. 5 illustrates another shape of a rotating cam unit for an engine of the present invention.

FIG. 5 illustrates another raceway 38*a* and 38*b* shape. This Figure illustrates the profile of both raceways 38*a* and 38*b* on a circular RCU 32. This shape also provides constant acceleration, however, the RCU 32 raceway 38*b* is only 10.5 inches wide at its widest dimension. The stroke is two inches and followers 40*a* and 40*b* having a 1.375 inch diameter are used. The shape of the raceways 38*a* and 38*b* on this RCU 32 are less preferred. This is because the small outside dimension causes the raceways 38*a* and 38*b* to have sharp corners. When the followers 40*a* and 40*b* move along the raceways 40 a and 40*b* of the RCU 32, high forces are applied to the followers 40*a* and 40*b*, because of the sharp turns.

Figure 6:
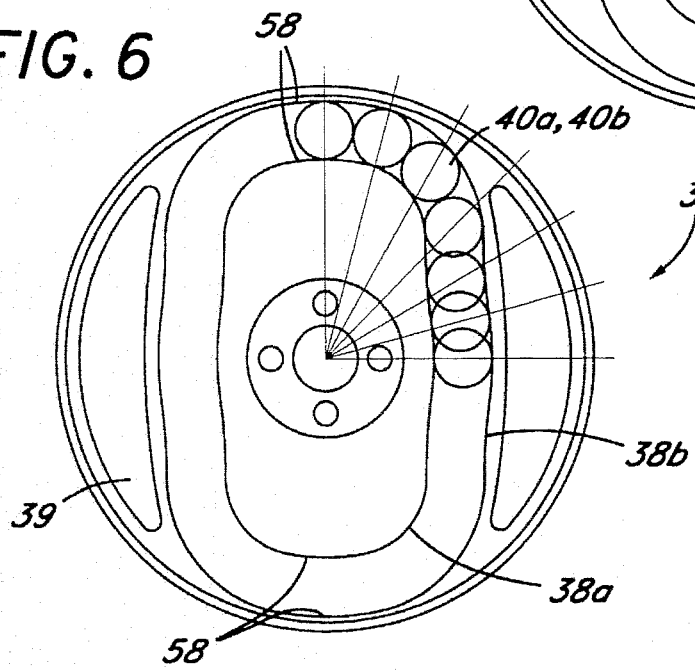
FIG. 6 illustrates a preferred shape of a rotating cam unit for an engine of the present invention.

FIG. 6 illustrates the preferred raceway 38*a* and 38*b* shape. This figure illustrates both raceway 38*a* and 38*b* profiles, as well as an RCU 32 having an outer circular profile. Adding this outer periphery area gives a structure which facilitates production of the RCU, and contributes a beneficial flywheel effect. This raceway 38*a* and 38*b* profile provides constant acceleration when the RCU 32 and raceway 38*b* is twelve (12) inches wide at its widest point. This raceway 38*a* and 38*b* is designed to provide constant acceleration when the piston 18 has a two inch stroke and the followers 40 have a diameter of 1.375 inches. This RCU 32 design is preferred because it minimizes the largest outside dimension, and at the same time has a raceway 38*a* and 38*b* profile which does not cause excessive force to be applied to the followers 40.

The RCU 32 may be manufactured in several different manners. In one method, the RCU 32 is forged out of high carbon tool steel in three parts: a core 33 and two outer wings 35 (see FIG. 3). The wings 35 are laser welded onto the core 33 in the configuration shown, and after annealing the RCU 32 is induction hardened and tempered. Then the RCU 32 is press fitted onto the main drive shaft 30. Next, the RCU raceway surfaces 38*a* and 38*b* are precision ground and the whole unit is then dynamically balanced.

Preferably, however, the RCU 32 is forged in two pieces which are then connected together. FIG. 6 illustrates one half of the RCU 32 when manufactured in this manner. In this embodiment, each half of the RCU 32 includes one half of the central core 33 and one wing 35. The two halves are secured together, by bolting or the like, and then the RCU 32 is fitted to the main drive shaft 30. The RCU 32 is precision ground to assure close tolerances.

As best seen in FIG. 3, the RCU 32 may have an exterior shape which mirrors the shape of the raceways 38*a* and 38*b*. As illustrated in FIG. 6, however, the RCU 32 preferably is cast in such a way that its outer dimension is circular and therefore not the same general shape as the raceways 38*a* and 38*b*. In this manner, extra mass is added to the RCU 32, while at the same time not affecting the amount of engine space necessary to accommodate the RCU 32. The extra weight on the RCU 32 allows the RCU to act as a flywheel, providing smoother rotation. Cut-out areas 39 provided in such a circular RCU achieve the optimum flywheel characteristics while at the same time limiting the flywheel mass.

Figure 7:
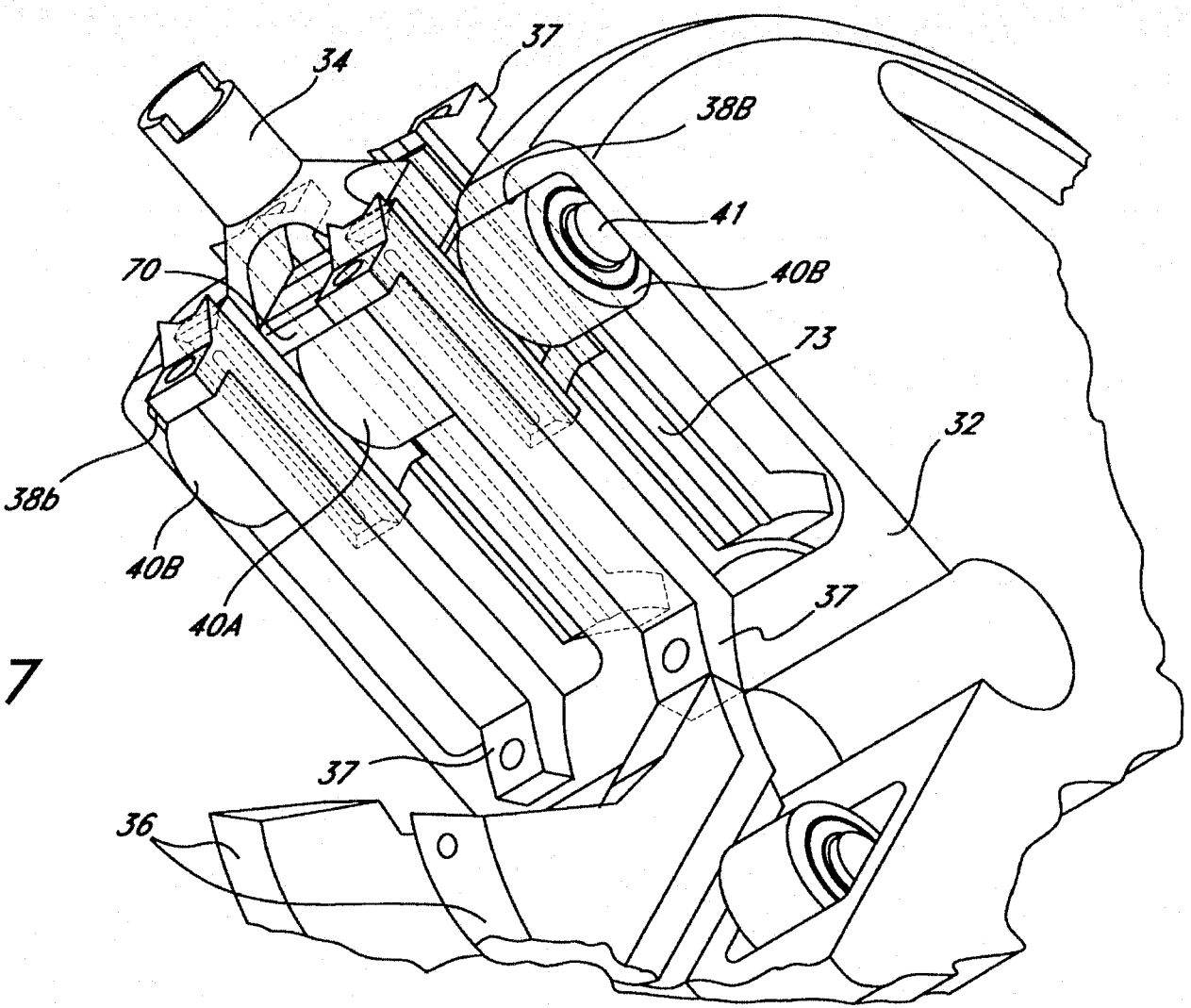
FIG. 7 is a perspective cut-away view of an engine of the present invention illustrating a connecting rod, followers, rod guides and rod guide plates.

FIG. 7 illustrates the means of interaction of the rod 34 and the RCU 32, and the mechanism by which the forces transmitted to the rod 34 at the rod/RCU interface during operation are controlled. Force control and dissipation are important in order for the engine 10 to operate smoothly and efficiently.

Figure 8:
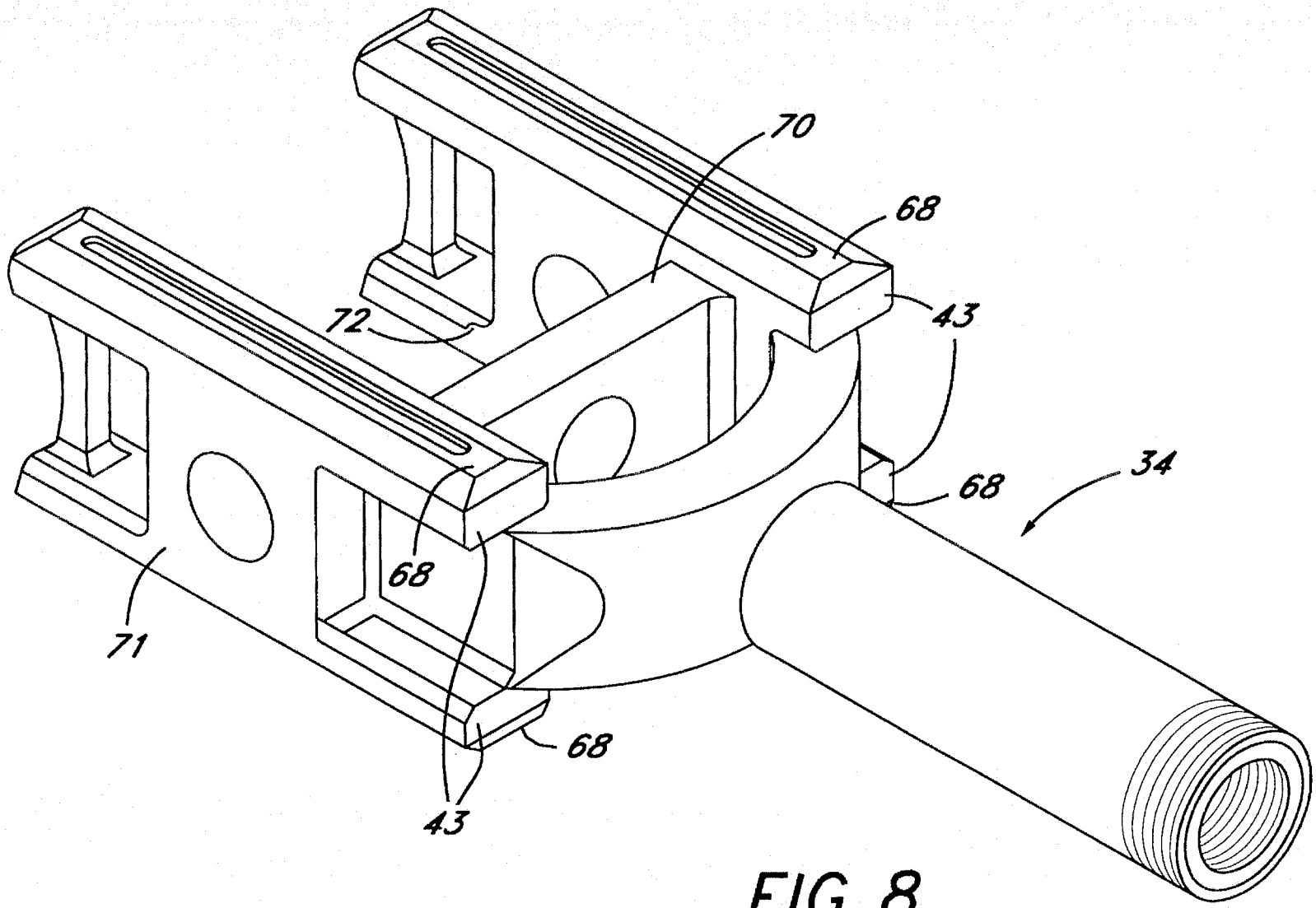
FIG. 8 is a perspective view of a rod and rod guide assembly for an engine of the present invention.

As can be seen in FIG. 7, but as best illustrated in FIG. 8, the end of the rod 34 closest the RCU 32, and opposite the end of the rod 34 connected to the piston 28, is shaped much like a pronged fork. Referring again to FIG. 7, in between the two prongs 71, 72 is mounted the center cam follower 40*a*, 40*b*. These three followers 40*a*, and 40*b*, 40*b* are preferably all mounted on a common shaft 41 which passes through the prongs of the rod 34. As discussed above, it is preferred that the followers 40*a* and 40*b* are rollers having a diameter of 1.5 inches, the followers 40*a* and 40*b* preferably containing needle bearings therein. It is possible to have followers 40*a* and 40*b* in the shape of a skid or sled, however, these embodiments are less desirable as they result in greater frictional resistance.

As illustrated in FIGS. 7 and 8, each of forks 71 and 72 have two elongate members or areas 43 formed thereon or attached thereto. Elongate members 43 are arranged parallel to the longitudinal axis of rod 34 and in paired opposing relationship, such that, on each fork, said members provide guide surfaces 68, In FIG. 8, four of such surfaces are illustrated: two on opposing sides of each fork. Surfaces 68 are preferably raised for engagement with rod guides 37. These surfaces 68 each engage a rod guide 37 located on or attached to a rod guide plate 36, as will be described in more detail below. A central support 70 may be positioned between the two forks 71, 72 of the rod 34 in order to provide added rigidity and load bearing capacity to the rod 34.

Referring again to FIG. 7, the piston 28 (not shown) is maintained in linear reciprocating motion through the use of the three cam followers 40*a* and 40*b* and the four rod guides 37 engaging the guide surfaces 68 of the rod 34. The center follower 40*a* rides in a rolling fashion upon the center raceway 38*a*. As the RCU 32 rotates to a point approaching one of the cam extensions 58, the RCU 32 pushes the follower 40A and connected rod 34 and piston 28 up into the combustion chamber.

Figure 9:
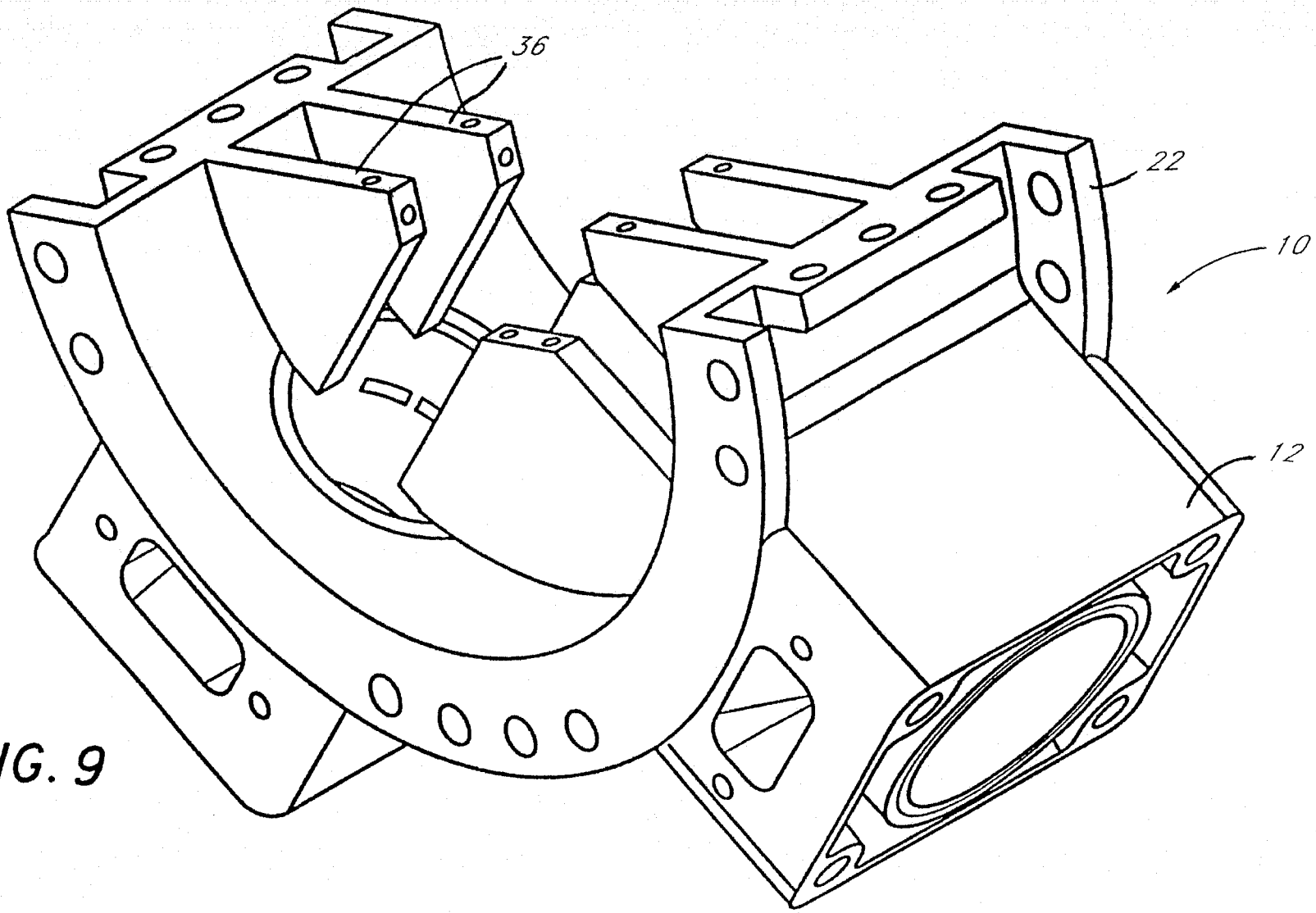
FIG. 9 is a partial perspective view of an engine block for an engine of the present invention.

The outer followers 40*b*, 40*b* ride on the outer raceways 38*b*, 38*b*. Because the outer raceways 38*b* face inwardly, as the RCU 32 moves away from one of the cam extensions 58 and to a position where the raceways 38*a* and 38*b* have a small dimension, the followers 40*b*, 40*b* are pulled downwardly by the outer raceways 38*b*, 38*b* of the RCU 32, thus pulling the downwardly piston down in the combustion chamber 42, as aided by the explosive force on the piston 28 which is transmitted to the center follower 40*a* and the center raceway 38*a*, As illustrated, the four members 43 of the rod 34 each engage a rod guide 37 mounted on a rod guide plate 36. The rod guide plates 36, as best seen in FIG. 9, are plates extending from the block 22 of the engine 10. As shown in FIG. 9, the rod guide plates 36 protrude from their at, attachment with the block 22 into the space between the wings 35 of the RCU 32 to a point, near the center raceway 38*a*. The plates 36 are arranged in two planes transverse to the longitudinal axis of the drive shaft 30 and extend along the block 22 to either side of the areas where each rod 34 is located.

Referring again to FIG. 7, each rod guide plate 37 connected to, or made part of, the rod guide plate 36. A slot 73 is located in each rod guide 37 for acceptance of the corresponding protrusion 68 extending from the member 43 on the rod 34. A fit is provided between each rod guide 37 and member 43, thus effectively locking the rod 34 in contact with the guides 37 in two directions, while at the same time allowing the rod 34 to slide up and down in the slots 72 in the rod guides 37.

The arrangement of the guides 37 and members 37 and 43 on the rod 34 effectively eliminates movement of the rod 34 in any direction except parallel to the axis of the piston 28 and combustion chamber 42. As described above, when the RCU 32 rotates, one set of forces tends to push the rod 34 and piston 28 up and down as described above in conjunction with the cam follower 40*a* and 40*b* and raceway 38*a* and 38*b* connection. However, at the same time, forces tending to push and pull the followers 40*a* and 40*b* connected to the rod 34 in a direction parallel to the direction in which the followers 40*a* and 40*b* roll occur at the RCU 32 follower 40*a* and 40*b* interface. These forces tend to push the rod 34 and piston 28 connected thereto in this same parallel direction. In the present embodiment, these forces are counter-acted and controlled by the containment of the rod 34 with the rod guide means 37 and are efficiently dissipated through the rod guide plates 36.

Further, forces also tend to push and pull the rod 34, and thus connected piston 28, in a direction perpendicular to the direction in which the followers 40*a* and 40*b* roll, or in other words parallel the shaft 41. These forces are also counter-acted through the connection of the rod 34 to the rod guide plates 36, since the slotted arrangement of the rod guides 37 does not allow the rod 34 to move in this direction.

Importantly, as illustrated in FIG. 7, the extraneous forces created at the RCU 32, follower 40*a* and 40*b* interface which do not act to push the piston 28 up, or pull it down, are transmitted through the followers 40*a* and 40*b* to the rod 34 and on to the rod guide plates 36. This design is particularly advantageous since the extraneous forces are directed away from their point of application at the followers 40*a* and 40*b* at the same point they are applied. The forces are transmitted directly to the rod guide plates 36 to the block 22. This eliminates force transmission to the piston 28 or rod 34 so as to prevent wear and binding.

Figure 10:
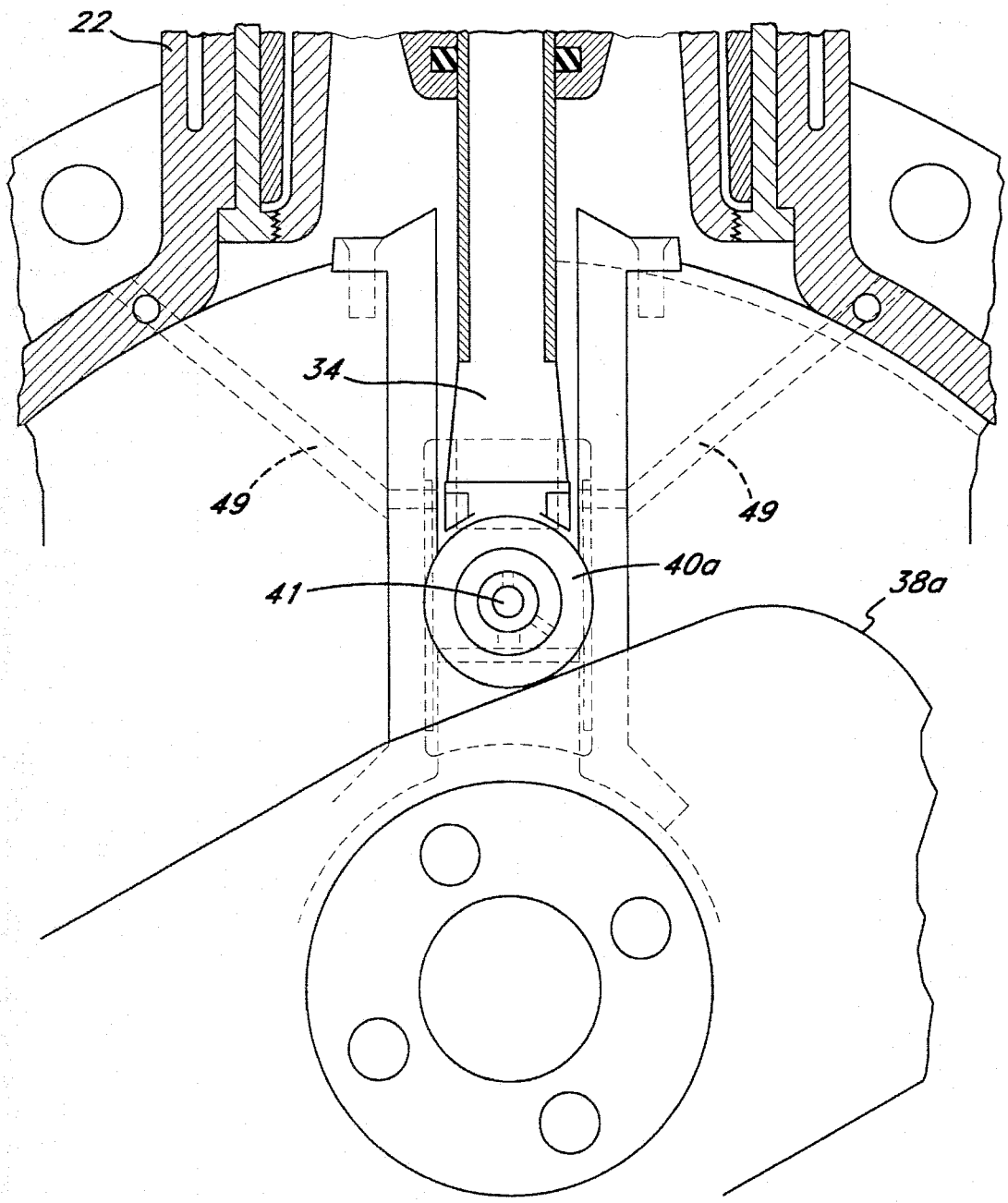
FIG. 10 is a partial cross-sectional side view of the region around a rod, followers and an RCU showing channels for supplying lubrication to the followers.

FIG. 10 illustrates the manner in which lubrication reaches the portion of the rod 34 which engages the RCU 32. As illustrated, oil pathways 49 extend through the rod guide plates 36 and rod guides 37 from a central oil pathway (hot shown) in the block 22. These oil pathways may either be drilled into the rod guide plates 36 and rod guides 37, or they may be formed by casting small tubes directly into the metal which forms the rod guide plates 36. These pathways 49 are used to deliver oil to lubricate the rod guide 37 and columnar member 43 interfaces, reducing friction.

Figure 11:
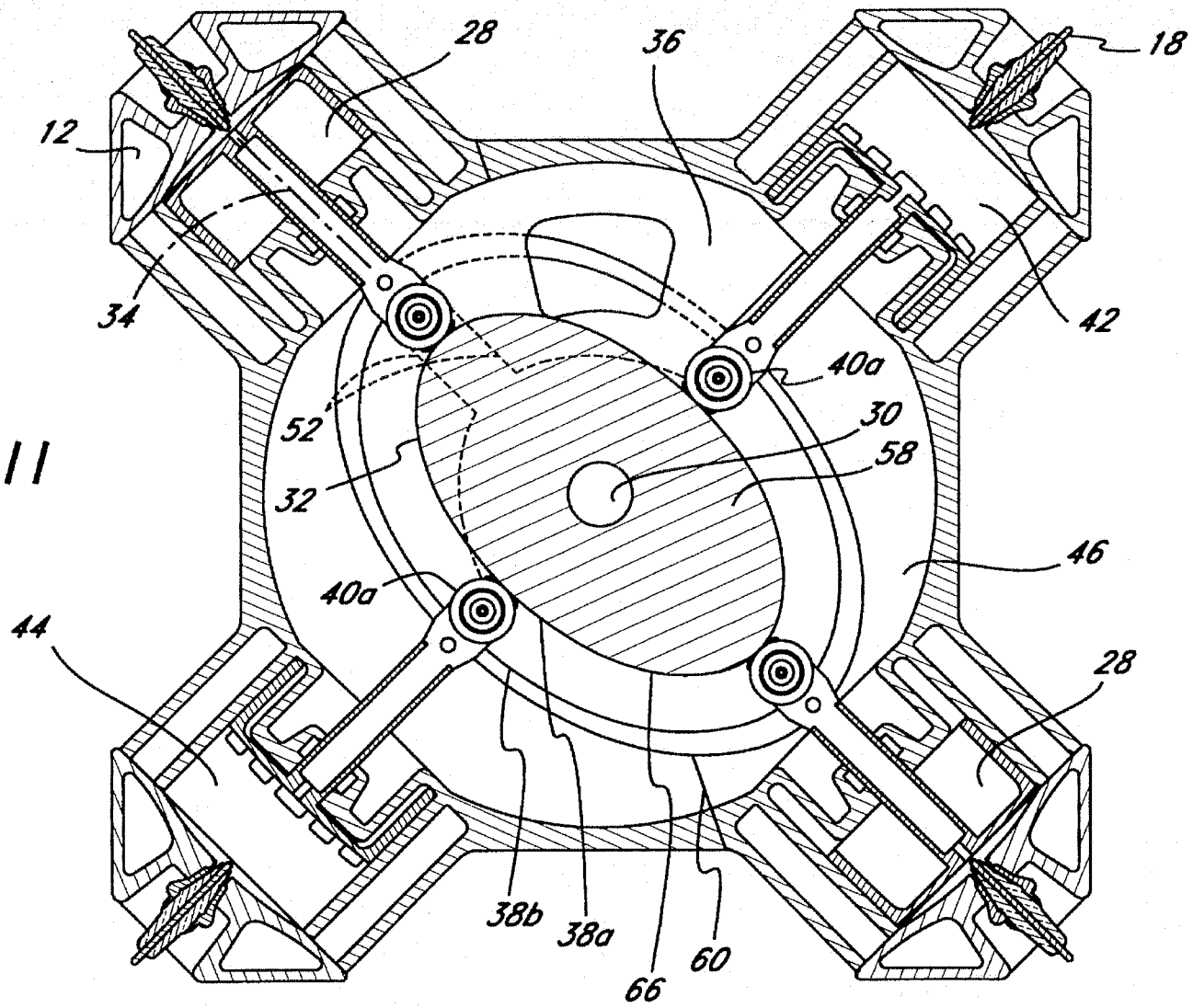
FIG. 11 is a cross-sectional view of an engine of the present invention taken along a plane extending perpendicular to the drive shaft.

FIG. 11 shows a sectional plan view of the present invention engine 10, wherein the engine 10 is sectioned in half by a plane extending at right angles to the axis of the drive shaft 30 and cutting through the cylinder heads 12. The RCU 32 (shown as an oval here, but as discussed above, other RCU shapes are preferred) is shown inside a sealed cam case 46 and in relation to the cam follower 40, connecting rod 34, piston 28, engine block. 22 and cylinder head 12. The preferred crisscross arrangement of the pistons 28 is also shown.

Detonation of the air/fuel mixture in the combustion chamber 42 forces the piston 28 in the direction of the drive shaft 30. This power stroke causes the cam follower 40*a* to push against the RCU raceway surface 38*a*. As a result, the RCU 32 begins its rotation about the drive shaft 30. The shape of the RCU 32 facilitates its rotation in response to inwardly directed radial pressure from each power stroke of the pistons 28. Indeed, the engagement of the cam extensions 58 against the cam follower 40*a* causes the former to be displaced laterally, ultimately resulting in the rotation of the RCU 32 about the drive shaft 30. Also, the raceway surfaces 38*a* and 38*b* which retain the cam followers 40*a* and 40*b* therein can be seen clearly in this view. As in conventional engines, each cylinder head 12 has a spark plug 18, exhaust ports 44, and a combustion chamber 42.

In the preferred embodiment, there are four cylinders 12 and two cam extensions 58 in the engine 10. Applicant has found that this arrangement results in an engine 10 that is smooth and efficient in operation. This is because there is almost always a piston exerting its force at any given time. It is apparent to those skilled in the art that a different number of cylinders and cam extensions may be used without departing from the scope of the present invention.

Still in FIG. 11, a block separation line 60 is shown. Along this line 60 is where the engine block halves come together during assembly.

Figure 12:
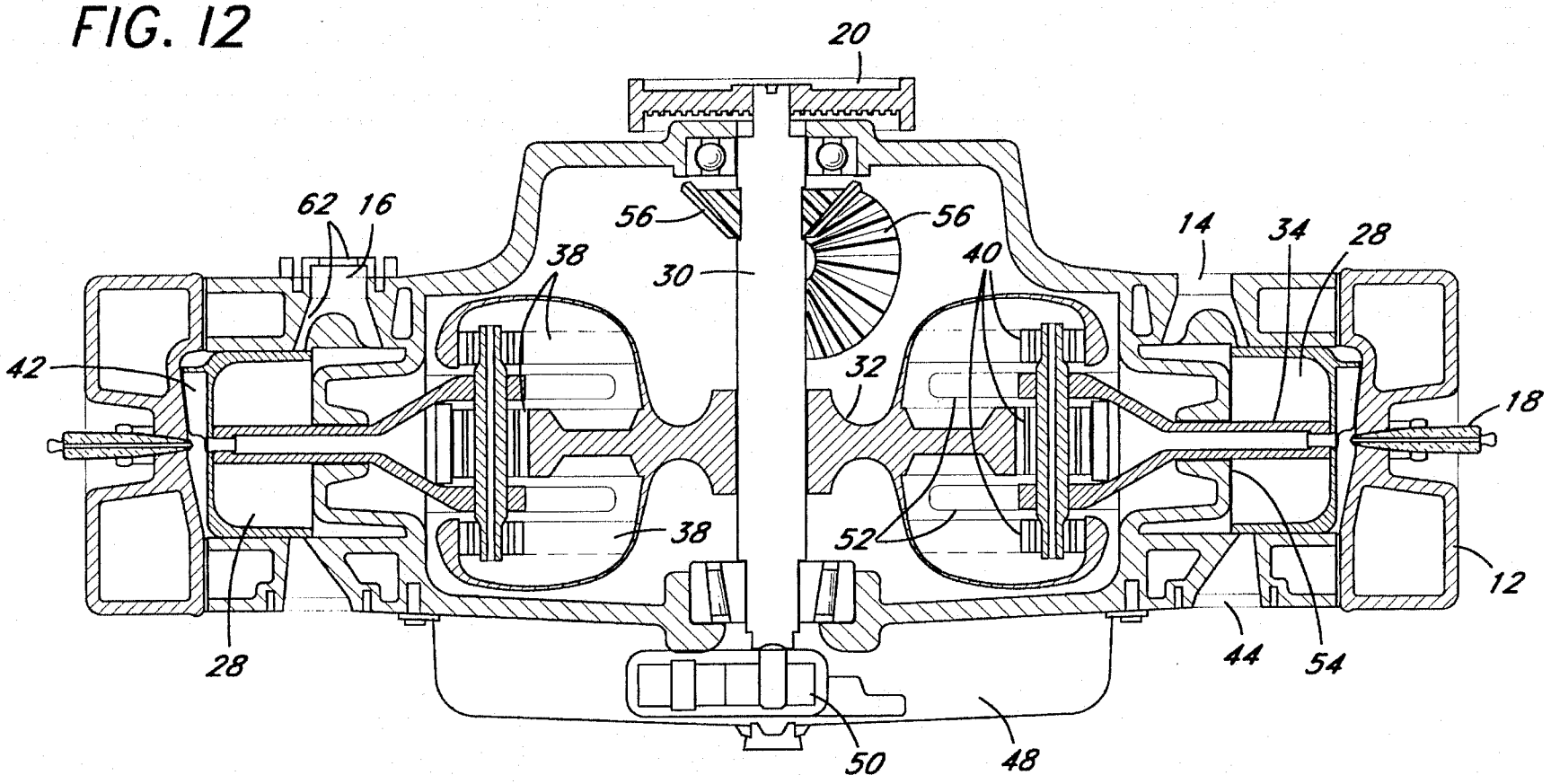
FIG. 12 is a cross-sectional view of an engine of the present invention taken along a plane extending parallel to the drive shaft.

FIG. 12 provides yet another cross-sectional view of the present invention, wherein the section cut is taken along a plane extending parallel to the main drive shaft 30. FIG. 12 provides an unobstructed view of the RCU-s cross section at its largest dimension. Also revealed is the cross section of the rods 34 and the relationship of the three cam followers 40*a* and 40*b* to the cross section of the RCU 32 and other parts. This figure illustrates how each rod 34 reciprocates through a brass guide and a neoprene seal 54 into the combustion chamber 42. Further, at the bottom of the drawing, the cross section of an oil pump 50 can be seen in an oil pan 48. This pump supplies the oil through the engine 10. On the upper part of the drawing is illustrated an alternate embodiment of the engine 10, wherein a gear drive system 56 is used to redirect the shaft 30 energy 90 deg. to another shaft, and wherein the accessory drive pulley 20 is located at the very top of the engine 10. As stated above, preferably, however, the shaft 30 of the engine 10 is connected to a transmission in direct fashion, without any change of force direction.

Fuel is directed through the injector port 16 via reed valve 62, into the combustion chamber 42, shown in FIG. 12. Air is introduced into the combustion chamber 42 through the intake port 14. After combustion, exhaust gases are pushed out through exhaust port 44 by the piston 28. Of course, as in a typical two stroke engine, as spent gases are expelled, a fresh air/fuel mixture is introduced into the combustion chamber 42.

FIG. 11 provides a good illustration of the various piston dispositions and all of the foregoing hardware in operation during the two stroke cycle of the present invention. In this illustration, it is assumed that the RCU 32 rotates clockwise around the drive shaft 30. At the instant when the fuel-air mixture is ignited by the spark plug 18 after compression, the piston 28 is situated at top dead center of cylinder 12, with the cam followers 40*a* and 40*b* situated at the top of cam extension 58. Immediately after the fuel air mixture explosion, piston 28 is forced downward in cylinder 12, with cam follower 40*a* making contact with a downward sloping edge of cam extension 58. That motion causes the RCU 32 and the drive shaft 30, to which the RCU 32 is keyed, to rotate in the, by example, clockwise direction. The piston 28 travels to bottom dead center; that is, when the piston 28 and connecting rod 34 have traversed to their closest point to the drive shaft 30. Next, immediately before the explosion of the fuel-air mixture and as the RCU 32 continues to turn in the same directions of the motion, piston 28 is forced upward into cylinder 12 as the cam follower 40*a* makes contact with a rising edge of the cam extension 58. In part, the piston 28 is forced upward by the rotational inertia of the RCU 32 and in part by combustion in other cylinders 12 which are just past top dead center.

After combustion when the piston 28 is cycling out of bottom dead center, the piston 28 forces burned gas out of cylinder 12 and simultaneously compresses the newly introduced air and fuel mixture. More precisely, the burned gases are forced out of the cylinder 12 by three forces: first, the vacuum produced by the exhaust system; second, the pressure of the burned charge; and third, the pressure of the incoming charge. The cycle is repeated, causing the new mixture to explode and again force piston 28 downward within cylinder 12.

As the RCU 32 turns,the rising edges on the cam extension 58 forces the cam followers 40*a* and 40*b* and associated piston 28 into the outer end of the cylinder 12. The piston 28 compresses the fuel/air mixture. At the time a low pressure in the combustion chamber 42 is pulling a fresh charge of air therein. As the piston 28 reaches the end of the stroke, the spark plug 18 again ignites the fuel/air mixture, causing explosion. The piston 28 is forced toward the centerline of the RCU 32. The forces are transmitted through the connecting rod 34 and cam followers 40*a* on to the falling edge 64 of the RCU's cam extension 58 thereby causing the RCU 32 and the interconnected drive shaft 30 to rotate. This action also compresses the next charge of air into the combustion chamber 42. As piston 28 nears the bottom of its Stroke, the exhaust port 44 is exposed in the bottom wall of the cylinder 12 and the exhaust gases start to exit. At this time, an electronic fuel injector known in the art (not shown) discharges its fuel into the injector port 16 of the combustion chamber 42. When the exiting exhaust gas pressure reaches a lower pressure then the pre-combustion pressure (approximately 70 psi), the reed valve 62 allows the air/fuel mixture to enter the combustion chamber 42 and the cycle repeats once again.

It is preferred that any two opposing cylinders be in the same phase and any two cylinders at right angles be 180 degrees out of phase with the first two. Thus, while oppositely disposed pistons are at top dead center, the two remaining pistons are at bottom dead center.

In the preferred embodiment, there are four cylinders and two lobes or cam extensions on the RCU. In an alternative embodiment, computer studies indicated that any number of cylinder configuration on one plane would also be within design parameters. In all configurations, the engines could be stacked to provide an engine of even greater power. The only constraints would be the amount of torque the output shaft could handle. The stacking of units would favorably influence the smoothness of the engine, as the number of power pulses would be increased with each layer. Normally aspirated engines of great power output, small size and low weight would result from such configurations.

The engine of the present invention may be used to power any device that is commonly powered by internal combustion engines. Automobiles, compressors, pumps, power generators, outboard engines, and aircraft may be potential users of the present invention engine, or scaled or stacked versions thereof. Because the present invention results in an engine which has a high power to weight ratio, and very smooth performance, it may be used in conjunction with devices that have not heretofore been used with an internal combustion engine. One example is a natural gas powered co-generation plant to heat, cool, and provide electrical energy for structures. Excess generated electrical power could then be sold back to the electric supplier. Such a use would favorably impact many of the energy problems facing this country and other nations today. The present invention engine would make such a system very cost effective and its smooth operation would be easy to live with. And the property owner would see a profit from the use of the system. This and other new applications will become apparent to those skilled in the art as they study the description herein.

Figure 13:
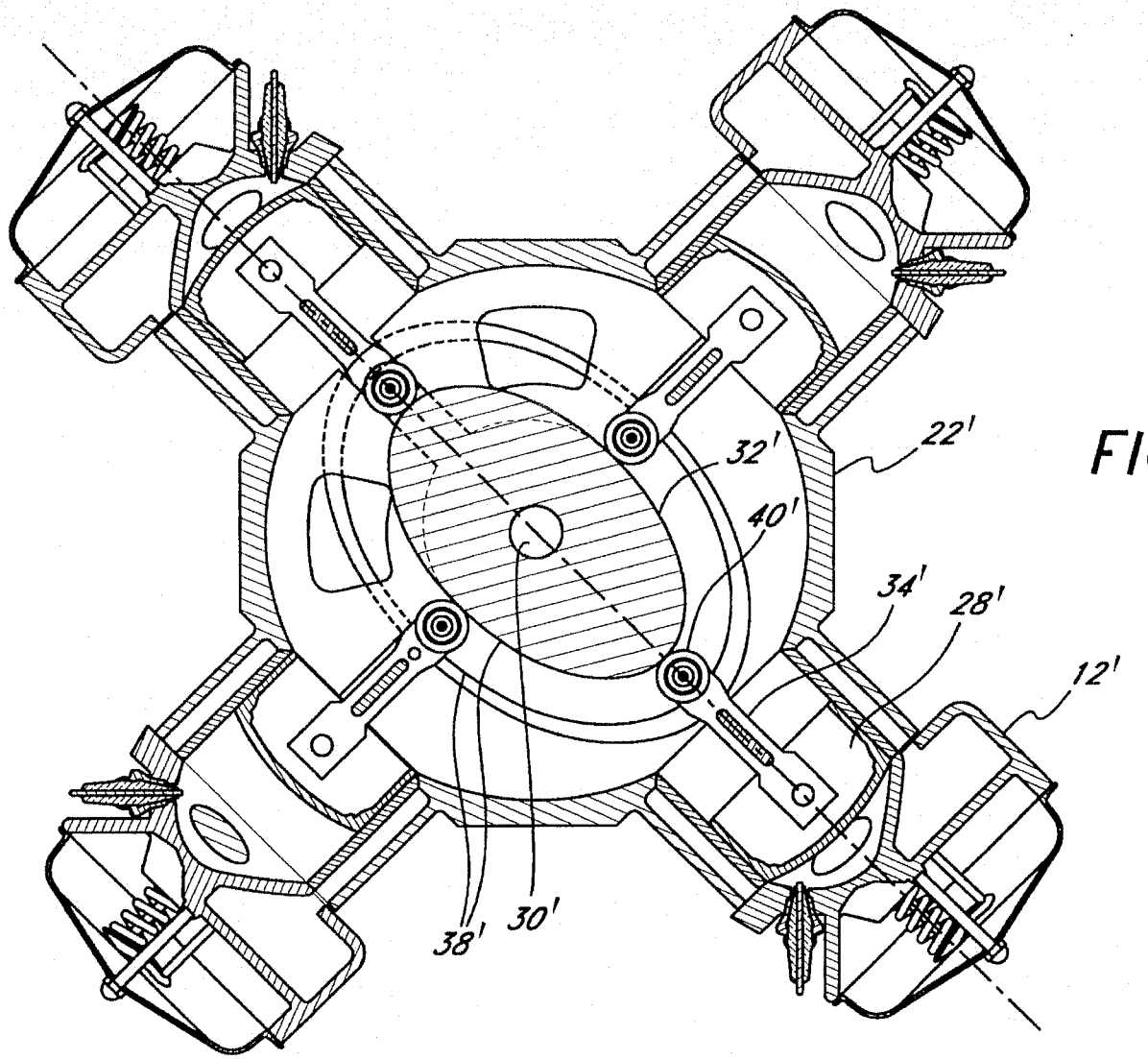
FIGS. 13 and 14 are sectional views of an alternative embodiment four cycle engine of the present invention.
Figure 14:
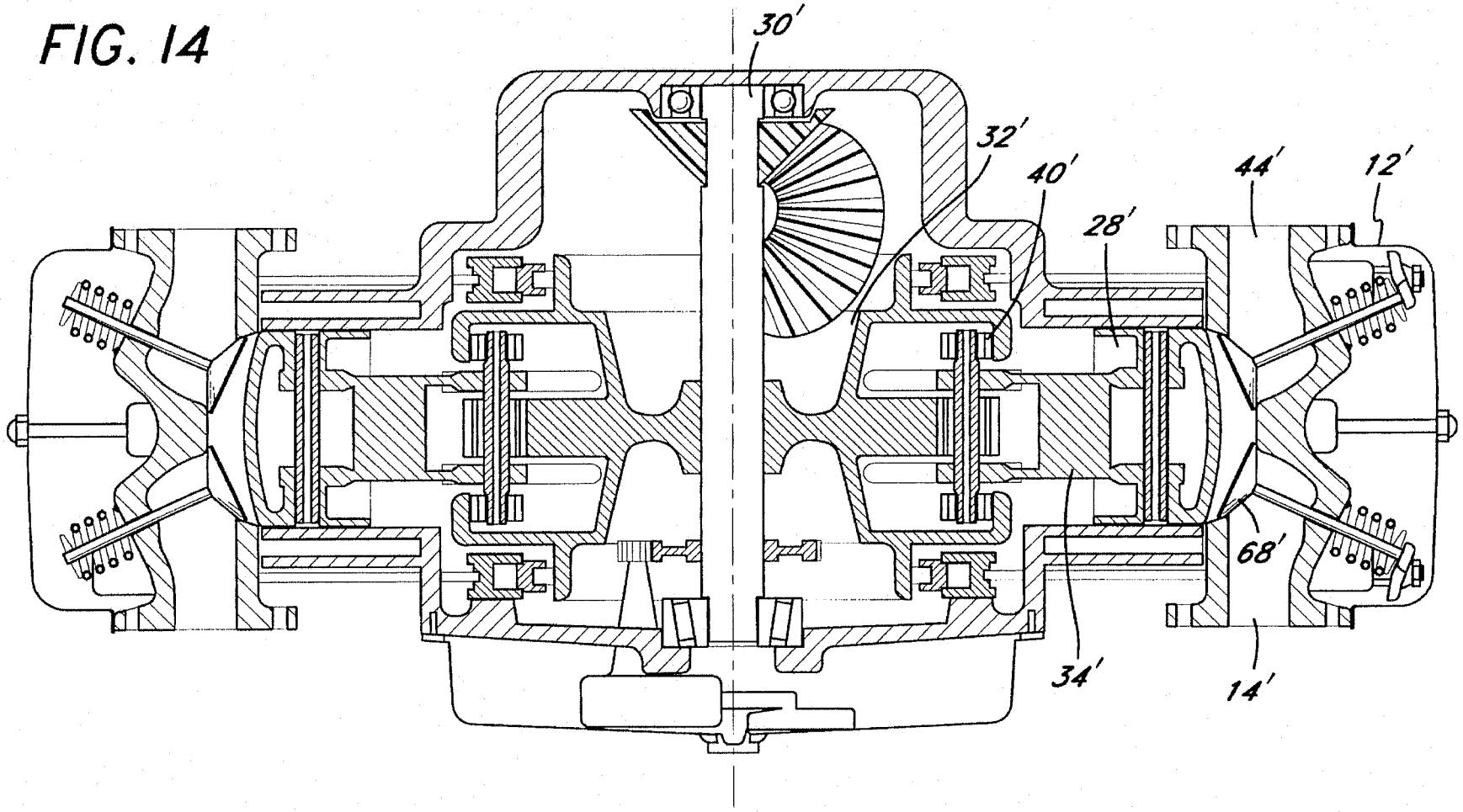

Numerous modifications and additions can and may be made to the process of our invention without departing from the spirit and scope thereof. By way of example, the stacked engine units may be set tandem and scaled up or down to provide small, light, high powered engines that fit many special applications. Or the RCU may be used in a four cycle or Diesel engine, such as that shown in FIGS. 13 and 14. FIG. 13 is a comparable sectional view to FIG. 11, except the former illustrates a four cycle internal combustion engine. Likewise, FIG. 14 is comparable to FIG. 12. The four cycle alternative embodiment of the present invention provides nearly the same structures as the two cycle preferred embodiment. For example, as shown in FIGS. 13 and 14, the engine has radially disposed cylinders 12'. 30'. As in the preferred embodiment, rotating cam unit (or RCU) 32' is connected to the drive shaft 30'. Cam followers 40' travel along raceway surfaces 38' of the RCU 32'. A connecting rod 34' links the cam follower 40' to the piston 28'. Accordingly, reciprocation of the pistons 28' thus translates to rotational motion in the RCU 32' through the foregoing structures.

FIG. 14 provides a better view of the intake port 14' and the exhaust port 44', located in the cylinder 12'. Valve 68' has been added to provide the proper control of influx and efflux of fuel/air and exhaust, respectively. Operation of the present alternative embodiment is like a conventional four-stroke engine, wherein the piston 28' reaches top dead center twice for one complete cycle. That is, once for compressing the air/fuel mixture, and the second time to discharge exhaust. Since four-cycle engine operation known in the art, no further discussion here is needed.

In yet another alternative embodiment, the RCU can feature an array of cam extensions disposed radially thereon. Further, the alternative embodiment-engine can be supercharged or turbocharged, both processes being well known in the art.

In still another alternative embodiment, spark plugs can be eliminated from the engine and the compression ratio increased to achieve auto ignition of the fuel. That is, the present invention easily converted to operate as a diesel engine. The foregoing examples are by way of illustration and are not meant to limit the scope of the following claims.

I claim:

1. A radial internal combustion engine with an engine block; a drive shaft rotatably disposed along a centerline of the engine block; a rotatable cam unit, said rotatable cam unit having a plurality of cam extensions, each of said cam extensions having a rising edge and a falling edge, said rotatable cam unit being mounted to said drive shaft, said cam unit being rotatable in a plane substantially perpendicular to said drive shaft;

a plurality of cylinders, pistons and piston rods arranged in a radial pattern around said rotatable cam unit;

at least one cam follower coupled to the end of each rod located opposite the end attached to said piston, said cam follower adapted to engage said cam extensions on said rotatable cam unit;

rod guide means for maintaining alignment of said rods and limiting the movement of said each rod in all directions except along its longitudinal axis, said guide means comprising male and female engagement members, one category of said members being associated with said rod for movement therewith, the other category of said members being fixed with respect to said rod, the improvement in the said guide means comprising:

four elongate members attached to each rod, said members being arranged in two pairs, one member in each pair facing in the opposite direction from the other.

2. The engine of claim 1 wherein said rod guide means include two series of guide plates attached to said engine, each series lying in a plane on either side of said cam plane, whereby movement of said rod is limited through engagement of said rod with said guide plates.

3. The engine of claim 2, wherein each of said guide plates in a series is spaced apart from adjacent members of the series to provide room for one of said rods to move therebetween, said adjacent plates providing facing guide surfaces for said rod to engage and move along.

4. A rod assembly for connection to a piston of an internal combustion engine; including a connecting rod having a centerline and two ends, one end of which is adapted for attachment to a piston, the other end of said rod having a forked shape; and including a plurality of elongate guide members attached to said forked end of said rod, each of said elongate members having a longitudinal axis which is substantially parallel to the centerline of said rod, the improvement comprising:

a protruding surface upon each of said elongate members for engaging guide means in said engine.

5. An internal combustion engine including;

an engine block and a drive shaft;

a plurality of cylinders and pistons arranged in a radial pattern in a plane substantially perpendicular to said drive shaft;

a plurality of connecting rods, each having first and second ends, each of said pistons being connected to one of said rods at said first end;

a cam, rotatable about said shaft in said plane, and having a plurality of cam surfaces around said cam, first and second of said surfaces facing inwardly towards said drive shaft, a third of said surfaces facing outwardly away from said drive shaft, said first and second surfaces being on either side of said third surface;

a plurality of cam followers coupled to each one of said rods at said second ends, first and second of said followers adapted to engage said first and second cam surfaces respectively, with a third follower adapted to engage said third cam surface;

so that, in use, when said cam rotates, said first and second cam surfaces engage said first and second cam followers to pull the connecting rod they are coupled to and said third cam surface engages said third cam follower to then push said connecting rod;

said followers comprise rollers, the improvement comprising:

said rollers are mounted to rotate about a common axis.

6. The engine of claim 5, wherein said rollers are mounted on said same axle and said connecting rod is attached to said axle.

7. A connecting rod assembly for attachment to a piston of an internal combustion engine in which reciprocating motion of said piston is transmitted by said rod to a rotatable cam including;

a shaft having a longitudinal axis and two ends, a first end of which is adapted for attachment to said piston;

three cam followers, each having a surface for engaging said cam and being mounted to said second end of said shaft with said surface substantially perpendicular to said axis, the improvement comprising:

said three cam followers being mounted symmetrically about a common axis.

8. A cam for an internal combustion engine for translating the reciprocating motion of pistons to the rotational movement of a drive shaft; the cam including a central cam body; a central cam surface on said cam body; and two outer cam surfaces on said cam body, one each of said outer surfaces lying on opposite sides of said central cam surface; the improvement comprising:

said outer surfaces lying in a plane circumferentially further away from a center of said cam body than the central cam surface.

9. A cam for an internal combustion engine for translating the reciprocating motion of pistons to the rotational movement of a drive shaft comprising:

a central cam body;

a central cam surface on said cam body; and two outer cam surfaces on said cam body, one each of said outer surfaces lying on opposite sides of said central cam surface;

said central cam surface faces outwardly from said body, and said outer surfaces face inwardly towards said body;

said outer surfaces lie in a plane circumferentially further away from a center of said cam body than the central cam surface.

* * * * *